US005917115A

United States Patent [19]

Wondris

[11] Patent Number: 5,917,115

[45] Date of Patent: Jun. 29, 1999

[54] APPARATUS FOR AND METHOD OF TREATING LIQUID METAL

[75] Inventor: Erich F. Wondris, Pittsburgh, Pa.

[73] Assignee: SMS Vacmetal, GmbH, Dortmund, Germany

[21] Appl. No.: 09/075,840

[22] Filed: May 12, 1998

Related U.S. Application Data

[60] Provisional application No. 60/046,581, May 15, 1997.

[51] Int. Cl.[6] ..... C21B 7/10

[52] U.S. Cl. ..... 75/508; 75/708; 266/165; 266/208; 266/211

[58] Field of Search ..... 75/508, 708; 266/165, 266/208, 211

[56] References Cited

U.S. PATENT DOCUMENTS

| | | | |
|---|---|---|---|
| 963,652 | 7/1910 | Reynolds . | |
| 1,131,488 | 3/1915 | Dolensky . | |
| 2,893,860 | 7/1959 | Lorenz . | |
| 2,906,521 | 9/1959 | Harders . | |
| 2,929,704 | 3/1960 | Harders . | |
| 2,993,780 | 7/1961 | Allard . | |
| 3,099,699 | 7/1963 | Breuing et al. . | |
| 3,201,226 | 8/1965 | Spolders et al. . | |
| 3,501,289 | 3/1970 | Finkl et al. | 75/508 |
| 3,650,517 | 3/1972 | Messing . | |
| 3,826,646 | 7/1974 | Karlsson et al. | 266/165 |
| 4,378,242 | 3/1983 | Harris et al. | 266/208 |
| 5,603,749 | 2/1997 | Stelts . | |

OTHER PUBLICATIONS

*Metallurgical Plant and Technology*, "Operation Technique and Plant Design of the VAD/VOD Process", Jun. 1985, pp. 36–45.

*Proceedings 14th PTD Conference 1995 of the Iron and Steel Society*, "Development of New Degassing Process in Yawata Works", pp. 13–20.

*The Making, Shaping and Treating of Steel*, "Secondary Steelmaking of Ladle Metallurgy", 10th Edition, 1985, pp. 677–690.

*33 Metalproducing*, "Degassing Primes the Pump for Profits", Oct. 1996, pp. 34–37.

*Steel Times International*, "Vacuum Process Engineering and Ladle Metallurgy in the Production of Steel", Jun. 1980, pp. 11, 14, 15, 17 and 20.

*Primary Examiner*—Melvyn Andrews

*Attorney, Agent, or Firm*—James L. Bean; Kerkam, Stowell, Kondracki & Clarke,P.C.

[57] ABSTRACT

A method of and apparatus for degassing molten metal in a vacuum treatment chamber defined by a open topped ladle containing the molten metal and a generally cylindrical refractory lined cover having a closed top and an open bottom positioned on the ladle, with a temporary joint formed therebetween, and a vacuum seal sealing the vacuum treatment chamber from the atmosphere. A vacuum offtake is connected to the cover chamber to apply vacuum to the vacuum treatment chamber, and the molten metal is stirred to produce sufficient turbulence and splashing to produce an increased surface area of molten metal exposed to vacuum to accelerate the degassing rate. The offtake outlet is located at a height above the cover chamber open bottom to substantially prevent splashed metal and slag from being carried into the offtake while permitting aggressive stirring to increase treatment rate.

35 Claims, 5 Drawing Sheets

APPARATUS FOR AND METHOD OF TREATING LIQUID METAL

This application claims benefit of U.S. provisional Application Ser. No. 60/046,581 filed May 15, 1997.

BACKGROUND OF THE INVENTION

1. Field of the Invention

This invention relates to the purification of liquid metals, and more particularly to apparatus for and method of purification of liquid metals by exposing the metal to vacuum.

2. Description of the Prior Art

Purification of liquid metals, especially liquid steels, by exposing the metal to subatmospheric pressure, commonly called vacuum, has long been known as shown, for example, in U.S. Pat. No. 963,652. Indeed, the benefits of using vacuum to remove dissolved gases and gases formed during chemical reactions of other elements in liquid steel was recognized by some metallurgist in the 19th century, but the first large scale trials of vacuum treatment of liquid steel did not take place until high capacity vacuum pumps became available and steel grades with improved physical properties were demanded by the fast emerging aircraft, electrical and other advanced industries, in the late 1940s.

Recognition of the metallurgical advantages available by vacuum degassing led to the development of vacuum treatment systems including stream degassing, recirculation degassing, and tank degassing systems. While stream degassers are used primarily for removal of hydrogen from liquid steel for heavy forgings, the recirculation and tank degassers are widely used for large scale vacuum treatment of many grades of steel utilized in a wide range of applications.

Recirculation degassers move a portion of the liquid metal from a ladle into a vacuum chamber through a snorkel attached to the vacuum chamber and having its lower end submerged into the liquid metal in the ladle. DH type degassers employ only one snorkel, with the liquid metal alternately flowing upwardly into the chamber for exposure to vacuum, then back into the ladle. DH recirculating degassing systems are disclosed in U.S. Pat. Nos. 2,906,521 and 2,929,704.

In a RH type recirculating degasser, two snorkels are employed. Liquid metal is caused to flow upwardly through one snorkel by the injection of lift gases, then returned through the second snorkel after exposure to vacuum in the treatment chamber. RH degassing systems are disclosed in U.S. Pat. Nos. 2,893,860 and 3,099,699.

Tank degassers were among the first commercial degassers employed to successfully treat molten steel and many of these devices are also in operation in steel plants around the world. Known tank degassers are shown in U.S. Pat. Nos. 1,131,488 and 2,993,780. In the typical tank degasser, a container or ladle holding a quantity of liquid steel, usually with some slag on top, is placed on a ladle stand in an open top vacuum tank by an overhead crane or the like. A gas or electromagnetic stirring system is then actuated, and the tank cover is placed on the tank, normally by use of a tank car which lowers the cover directly onto the tank. A vacuum-tight closure is affected between the top and tank, normally by an O-ring seal positioned between flanges located one on the tank top and the other on the cover. Usually, the tank is connected to the vacuum pumps by a large diameter off gas line. The stirring operation exposes an increased surface area of liquid steel to the vacuum.

In the typical tank degassing operation, gas stirring is used in which an inert gas, typically argon, is injected into the bottom of the ladle through gas permeable refractory elements. Before, during and after degassing, the temperature and chemical composition of the metal are monitored and alloy materials may be added, as required.

In a variation of the tank degasser just described, the tank and ladle are supported for movement along a track to a position beneath the cover, after which the cover may be lowered or the tank raised to affect the seal. In either embodiment, the off gas line may be connected either to the tank cover or to the tank.

It is also known to degas molten steel by use of a ladle cover degasser which, in effect, is a variation of the tank degasser systems. The principle difference is that the ladle, having a sealing flange installed, acts as a vacuum tank. In this type degasser, the size of the ladle cover is relatively small. Again, typically an O-ring seal is employed for sealing the flanges on the cover and the ladle. The off gas connection is through the ladle cover. A ladle cover degasser is shown in U.S. Pat. No. 3,201,226.

It is also known to employ an oxygen lance for injecting oxygen onto liquid steel during vacuum treatment in a tank degasser. These systems are commonly referred to as vacuum oxidation decarbonization or VOD systems, and are employed mainly for the reduction of carbon in steels having a high chromium content.

When using a tank degasser as a VOD system for the production of very low carbon stainless steels, a cooled, vertically movable oxygen lance extends through the top of the tank cover for injecting oxygen onto the molten metal during vacuum treatment. Under vacuum, oxygen preferentially combines with carbon over relatively highly oxidizable alloys. The above-mentioned U.S. Pat. No. 3,201,226 also shows a system operating in this manner.

Large quantities of ultra low carbon steel, i.e., steels having carbon content of 50 ppm or lower, are currently used by the sheet metal forming industry, e.g., the automobile and appliance press shops. These steels, especially when microalloyed with titanium and other metals, often called interstitial free or IF steels, have excellent formability even under adverse conditions, and are produced commercially by processes which include vacuum degassing. Recirculating type degassers are widely used for the production of these grades largely because of the high production capacity of such degassers. As is known, however, recirculation type degassing systems are more expensive than tank degassers not only from the standpoint of initial cost, but also from the operating standpoint. Accordingly, while it would be advantageous in some steel plants to employ a tank degasser for the production of ultra low carbon steel, the known tank degassers generally have not been readily adaptable to such high output vacuum degassing operations.

When decarbonizing in vacuum, large volumes of carbon monoxide gas can be formed. The evolving gas volume is further increased by the gas used for stirring and the dissolved gases such as hydrogen and nitrogen which are removed under vacuum. This can produce a violent boiling or stirring action, which is beneficial from a metallurgical standpoint because of the increased surface area of the metal being exposed to the vacuum, enhancing the rate of desired metallurgical reaction. At the same time, the violent splashing will result in formation of buildups and skulls on degasser components which may restrict the flow of off gases to the vacuum pumps and may adversely affect structural integrity and cause thermal distortion, thereby effecting the vacuum seal.

Tank degassers in commercial use generally have a refractory lined or water cool splash shield suspended from the tank cover to prevent the splashed liquid steel and/or slag from reaching the vacuum tank cover. The tank covers, per se, generally are not able to withstand exposure to the extremely high temperatures, particularly those resulting from localized contact with the splashed liquid. Distortion of the tank cover can not only interfere with the seal, but also adversely affect operation of sensitive mechanical equipment required for operation, testing and alloy additions, and the like. The splash shield thus is generally considered essential for protecting the cover, but at the same time effectively reduces the height available for splashing, i.e., the height from which steel or slag particles return to the steel in the ladle. Buildups on the shields inside the tank and offtake not only restrict gas flow but also results in expensive maintenance. To overcome these problems, it is common practice to treat smaller quantities of metal than is normally contained in a ladle. By reducing the volume of liquid steel in the ladle, more freeboard is provided—often 30 to 50 inches—for the desired stirring and splashing to expose the metal to vacuum, but this inherently results in a reduced output or production.

It is, therefore, an object of the present invention to provide an improved tank or ladle cover type vacuum degassing facility capable of vacuum treatment of liquid steel at a high rate.

Another object is to provide an improved method of producing vacuum degassed steel.

Another object of the invention is to provide an improved vacuum degassing apparatus which is efficient in operation and which requires a minimum of maintenance.

Another object is to provide a method of and apparatus for producing vacuum degassed steel in a degasser employing a cover assembly which permits effective degassing at an increased production rate.

Another object is to provide an improved high production tank or ladle cover type vacuum degassing facility which is more economical to build, install, operate and to maintain than typical recirculating degassers.

SUMMARY OF THE INVENTION

The foregoing and other objects and advantages are achieved in accordance with the present invention employing an improved tank degasser or ladle cover degasser vacuum treatment apparatus including a cover assembly which enables increased splashing and turbulent reactions within the space the metal is being treated, thereby permitting a higher rate of chemical reactions and a shorter treatment time. The cover assembly preferably has a refractory lined, generally cylindrical body or cover chamber having a closed top and an open bottom. The cover extends a substantial height above the top of the ladle or other vessel containing liquid steel to be vacuum treated, and the off gas pipe inlet is located in, or adjacent to the top of the cover to substantially avoid the splashed metal and/or slag from reaching the off gas inlet. The inside shape and dimension of the refractory lined cover chamber corresponds substantially to the inside diameter of the ladle top so that the cover becomes, in effect, a vertical extension of the ladle's freeboard, thus making it possible to treat ladles with much less freeboard than commonly used in known tank degassers.

The refractory lined cover chamber may be maintained at a temperature sufficiently high so that molten metal and slag splashing onto the inner surface flows back freely into the ladle, thereby improving the metallic yield of the process, and preventing splashes from forming large buildups. Preferably a temporary, refractory joint is placed between the ladle rim and the bottom edge of the cover chamber to form an effective seal avoiding spillage. A vacuum-tight closure between the cover chamber and tank, or the cover chamber and ladle of a ladle cover degassing system, is accomplished by mating flanges which may incorporate an O-ring sealing element and which may include water cooling or other cooling means, if desired.

The overall height of the cover chamber will, of course, depend to some extent on the ladle or other metal container with which the unit is employed, with larger diameter ladles requiring a somewhat taller cover chamber to accommodate the height and trajectory of splashes produced by the aggressive stirring desired to effectively treat a large heat of steel in an acceptable length of time. Also, as previously indicated, the location of the off gas exit port, i.e., connection between the cover chamber and the vacuum pumps and located either at the top or at the sidewall adjacent to the top, will effect the overall required height of the cover chamber. Generally speaking, the preferable height of the open interior of the cover chamber above the ladle top to the lowest point of the off gas outlet will depend on the type of steel to be treated and the general operating philosophy of a melt shop. For ladles of a size commonly used in the primary steel industry, this height should be at least about 50% of the inside diameter of the ladle cover chamber refractory lining. Preferably, this height will be from about 75% to about 150% or more of the diameter of the ladle cover chamber. It is understood that the greater this height, within practical limits, the greater the permissible rate of reaction without producing excessive buildups in the cover chamber and off gas outlet. In any event, the off gas connection is to the cover chamber, and not to the degasser tank per se as is the case in commercial tank degassers.

DESCRIPTION OF THE DRAWINGS

The foregoing and other features and advantages of the invention will be apparent from the detailed description contained herein below, taken in conjunction with the drawings, in which.

DESCRIPTION OF THE PREFERRED EMBODIMENTS

Figure 1:
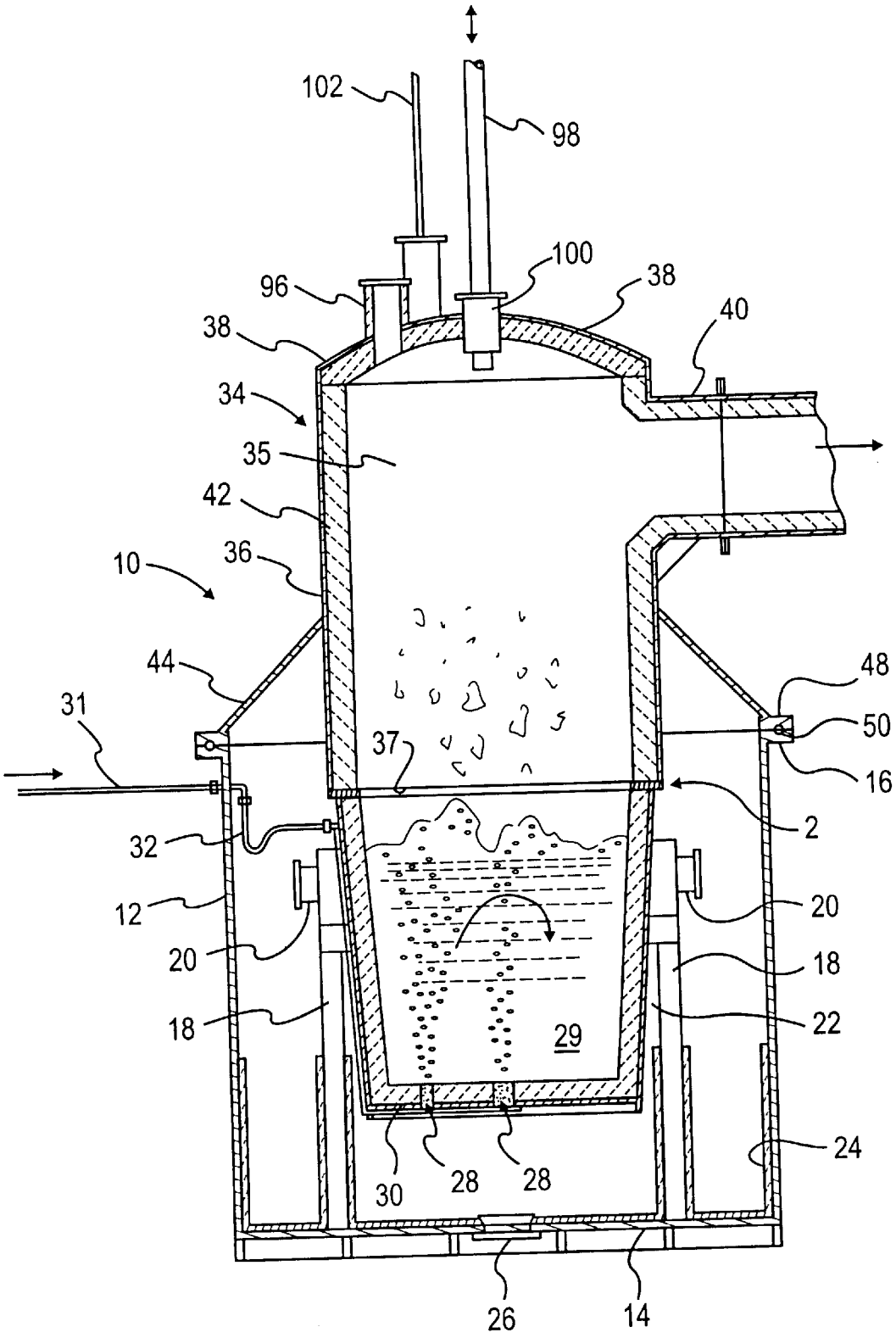
FIG. 1 is an elevation view, in section, of a tank type degasser according to the present invention.

Referring now to the drawings in detail, an improved tank type degasser apparatus according to the present invention and in use to degas molten steel contained in a ladle is indicated generally in FIG. 1 by the reference numeral 10. The apparatus includes a generally cylindrical tank 12 having a closed bottom shell 14, and an open top having a flange 16 extending therearound. A ladle support stand 18 is mounted within the tank and projects upwardly from the bottom shell for receiving and supporting the trunion block 20 of a conventional ladle 22. The inner bottom portion of tank 12 and ladle stand 18 may be provided with a protective refractory coating 24, and the bottom shell 14 may be provided with a break-out plate 26 made of a suitable low melting material such as aluminum for protecting the tank in the event of ladle failure or a major spill.

In the embodiment shown in FIG. 1, the ladle 22 is provided with a pair of porous refractory blocks 28 in its bottom, and a conduit system 30 rigidly connected onto the outer surface of the ladle shell provides a gas flow path to the refractory blocks 28 for injecting a stirring gas, preferably argon, into and stirring of the molten steel 29 in the ladle. A piping system 31, including a flexible, quick disconnect hose 32, is provided to supply the stirring gas, under pressure, to the ladle after it is placed on the stand 18 by an overhead crane or the like (not shown). An available fast automatic gas connecting device can also be used which actuates the gas flow when the ladle is placed in position.

The degasser assembly 10 also includes a movable cover assembly indicated generally at 34 which is adapted to be moved into position over and lowered onto the tank 12 in a manner described more fully herein below. The cover chamber 35 includes a generally cylindrical, upright outer metal shell 36 of the cover chamber, with an open bottom 37 and a top closed by a dome shaped shell 38. An off gas outlet 40 is rigidly joined to the shell 36 adjacent the top 38, with the outlet 40 in fluid communication with the interior of the cover chamber. As explained more fully hereinbelow, offtake 40 is located at a height above the open bottom 37 to minimize the buildup of molten metal and slag in the outlet. The rigid metal cylindrical shell 36 of the cover chamber 35, the top dome 38 and the off gas outlet 40 are all provided with a refractory lining indicated generally at 42 in FIG. 1.

An outwardly and downwardly extending skirt 44 has its top or small diameter end rigidly joined as by welding to the outer cylindrical surface of shell 36, at a location between the offtake pipe 40 and the open bottom end 37 of the cover. Skirt 44 terminates at its downwardly directed open end in an outwardly directed flange 48 adapted to mate with flange 16 to support the cover assembly on tank 12, and a suitable O-ring vacuum seal 50 may be provided between flanges 16 and 48. The open bottom end 37 of cover chamber is preferably located in a position slightly above the open top of ladle 22 for reasons more fully explained below.

Figure 2:
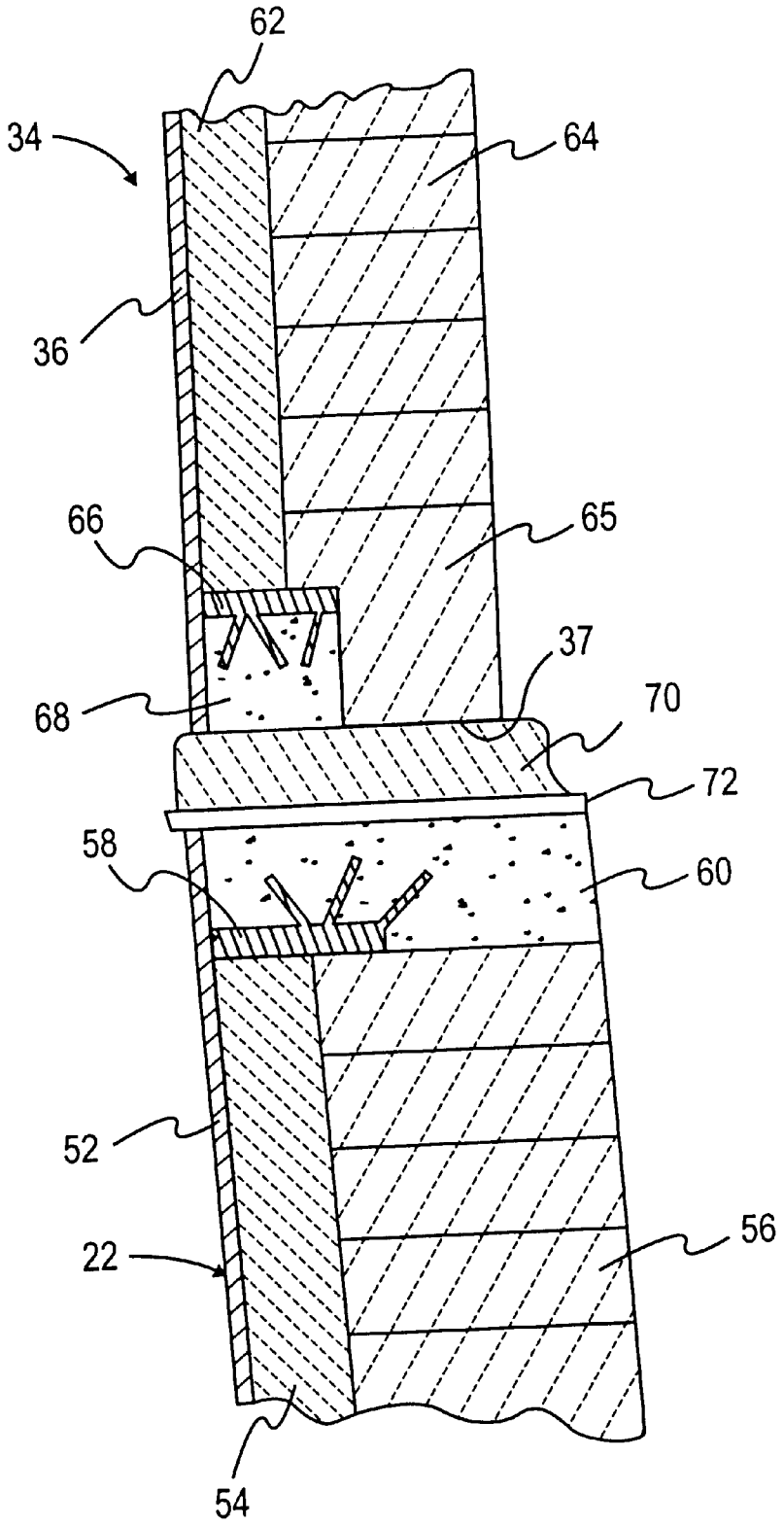
FIG. 2 is an enlarged fragmentary sectional view of a portion of the structure shown in FIG. 1.

Referring now to FIG. 2, the joint between the ladle 22 and cover 34 employed in the configuration of the invention illustrated schematically in FIG. 1 will be described in detail. As is typical, the ladle 22 comprises a rigid outer metal shell 52 having a refractory lining consisting of an outer, or backup refractory layer 54 and an inner or working lining 56 consisting in this example of refractory bricks. An annular metal shelf ring 58 mounted on shell 52 extends inwardly over layer 54 and a portion of layer 56 at a location spaced slightly below the open top of shell 52, and a castable refractory ring or a precast ceramic ring 60 overlies the top surface of metal ring 58 and the top of refractory layer 56 to provide a smooth top surface for matching with the open bottom edge of the cover chamber 34. Generally, this ladle structure is used in steel plants today.

The outer steel shell 36 of the cover chamber 35 is also provided with a multilayer lining consisting of similar outer or backup refractory layer 62 and an inner refractory brick working lining 64 including a retaining brick course 65 retained in position by a steel shelf or ring 66. Again, a castable refractory material 68 covers and protects the shelf 66 and cooperates with the lowermost course of refractory brick 64 to form a smooth open end surface around the periphery of the cover for proper matching with the top of the ladle 34.

When the cover assembly 34 is positioned on tank 12 with flange 48 resting on flange 16, the open bottom end 37 of the cover chamber preferably is spaced slightly above the top surface of the ladle as defined by the refractory ring 60. An effective joint is provided between the cover chamber 35 and the ladle by a layer of refractory material 70. The refractory 70 may be in the form of a cold formable refractory material which is placed on the top of the ladle either shortly before or after positioning the ladle in the tank, utilizing suitable means such as a mechanical robotic arm. When the cover assembly is lowered onto the tank, the formable refractory layer will still be sufficiently plastic to flow and form an effective, temporary refractory joint between the ladle and cover. This material is of sufficient thickness to accommodate any distortion and/or minor slag deposits or splashing which may be present on the rim of the ladle, but quickly sets under the heat of the ladle top and of the cover to form an effective joint or seal which will prevent molten metal from escaping between the cover 34 and ladle 22 during vacuum treatment. To assure that pressure will equalize between the tank and the vacuum treatment chamber defined by the cover chamber 35 and the interior of the ladle, and in order to enable a more rapid pump down, or pressure reduction, one or more small refractory vent pipes 72 preferably are positioned on the ladle rim on top of surface 60 prior to application of the plastic refractory layer 70. Such vent pipes also guard against the possibility of drawing the plastic material of the layer 70 into the vacuum treatment chamber. While tubes 72 permit equalization of pressure within the tank 12 and vacuum treatment chamber, they are of a sufficiently small size to effectively prevent any flow of liquid steel or slag into the tank as a result of splashing from violent stirring during treatment.

While sealing layer 70 is illustrated as a cold formable refractory material, it is understood that deformable refractory bricks or blocks may be employed to form the temporary joint. Also, it is understood that proper shields or diverters may be employed during tapping of molten metal into the ladles, and mechanical scraping or cleaning of the ladle rim may be employed during a ladle turn around and before applying the refractory layer 70 to improve the temporary heat resistant joint between the ladle and cover chamber. Joint material may be readily removed and replaced as required.

It is also contemplated that the top surface of the ladle lining and the bottom surface of the cover chamber may be contoured so as to interfit, e.g. in a shiplap type joint to produce a joint which will effectively prevent molten metal and slag splashed upward from the ladle from flowing outwardly from the vacuum treatment chamber. In this arrangement, the vent tubes may not be required.

Figure 3:
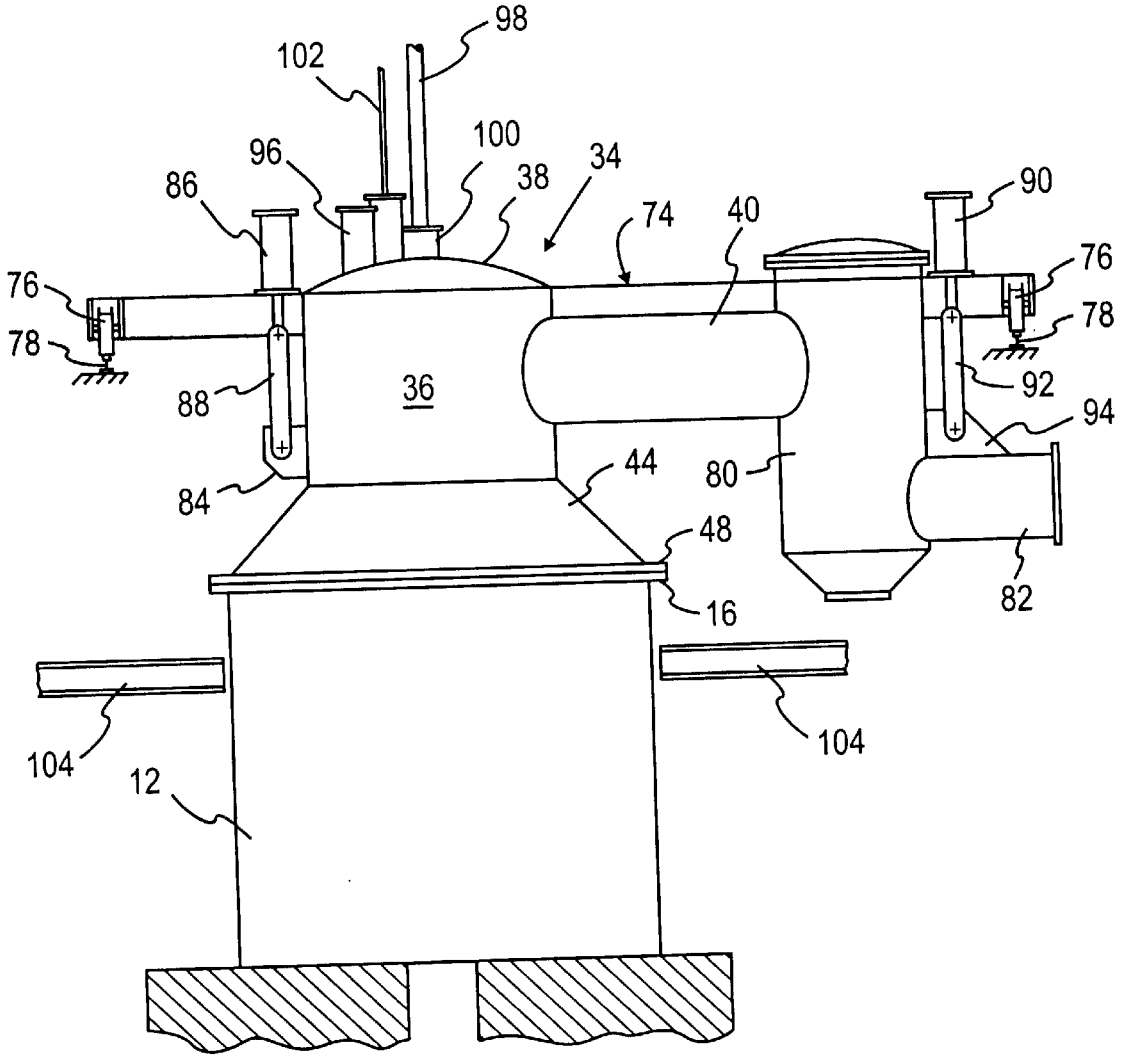
FIG. 3 is an elevation view of the degasser assembly schematically showing a vacuum line connection to the cover mounted on a cover car for movement therewith.

Referring now to FIG. 3, the arrangement for moving the cover assembly and associated equipment into position above a vacuum tank, and for lowering the assembly onto the tank for treatment of a ladle of molten metal, is schematically illustrated. In this arrangement, a tank cover car 74 is supported by trucks 76 for movement along rails 78 for movement from the treatment position shown in FIG. 3 to a retracted or parking position spaced laterally from the tank 12. The vacuum, or offtake line 40 is a structural pipe element having its outlet connected to a off gas cooling unit 80 which, in turn, has its outlet connected to an off gas connecting line 82 for connection with the vacuum pumps in a suitable manner. A rigid bracket 84 is joined as by welding onto the outer surface of shell 36, and a hydraulic cylinder 86, supported on car 74, is connected, through a linkage 88 to bracket 84. A similar hydraulic cylinder 90 and linkage 92 is connected, through a second bracket 94 rigidly joined as by welding on off gas cooler 80 and off gas outlet pipe 82 so that actuation of cylinders 86 and 90 can raise and lower the cover assembly and off gas cooler.

Auxiliary treatment apparatus may be mounted on the cover assembly 34. For example, an alloy addition port 96 may be provided in shell 38 and an alloy addition system (not shown) capable of supplying alloys under vacuum may be provided to add alloy materials as needed during treatment. Similarly, a lance 98 may be provided, using a sealed lance port 100, for injection of oxygen during treatment, or for heating as explained below. A suitable lance-type sensor and/or testing system 102 may also be provided. The alloy addition equipment, oxygen or multi-purpose lance, and testing equipment are known and are illustrated only schematically.

As previously indicated, the cover assembly 34, including the cover chamber 35, offtake pipe 40, off gas cooler 80 and cooler outlet 82 are welded or mechanically joined together to provide a rigid structural unit which is suspended by the hydraulic cylinders 86, 90 for vertical movement to and from the treatment position. While only two hydraulic cylinders are illustrated, more than two may be used, as required. Car 74 is driven by suitable motor means, not shown, and controls are provided for accurately positioning the assembly. A working platform, indicated schematically at 104 is provided adjacent the open top of the tank 12.

In operation of the vacuum tank degasser system just described, the cover assembly carried by the cover car 74 is located at a retracted or parking position spaced laterally from the tank 12 while a ladle of molten steel is placed on the ladle stand 18 within the tank. Short lengths refractory vent pipe 72 are then positioned on the edge of the ladle, and a layer of cold formable, plastic refractory material 70 is spread around the top rim of the ladle. This process can also be performed before the ladle is lowered in the tank. In the absence of an automatic stirring gas connecting system, the stirring gas tube 32 is then connected. The cover car 74 is then moved to position the cover chamber directly above the ladle before the cylinders 86, 90 are actuated to lower the cover assembly to seat flange 48 onto flange 16, with the O-ring seal 50 in position to form a vacuum-tight joint. In this position the lower open end 37 of the cover 34 engages and forms the plastic refractory mass to obtain an effective joint between the cover and ladle, with the tubes 72 providing vents, at spaced positions around the ladle top, between the vacuum treatment chamber and the tank outside the ladle.

At this position, treatment can commence by starting the vacuum pumps to apply vacuum within the cover. As is known, vacuum pumps are commercially available for applying a sufficiently reduced pressure to effectively degas the molten steel while at the same time withdrawing gases evolved. The removed gases are cleaned and processed before being discharged to the atmosphere.

After a desired vacuum level has been reached, oxygen blowing can start if required to assist decarbonization and/or to provide conditions for heating of the liquid steel.

During treatment, the stirring gas injected for exposing more surface area of liquid steel to vacuum by producing violent boiling, together with the formed carbon monoxide and extracted hydrogen and nitrogen gases, may produce splashes extending upwardly into the cover chamber. Some of these splashes inherently contact the hot inner surface of the refractory lining 64, and drain back into the ladle, flowing over the joint 70 without spilling into the tank. The refractory lining of the cover chamber is maintained at an elevated temperature so as to avoid excessive sticking or buildups of metal and slag on the cover chamber wall. This also improves the metal yield from the treatment process.

The offtake pipe 40 is connected to the cover chamber in or adjacent to the top wall thereof at a height above the cover chamber open bottom 37 which will minimize the buildup of metal and slag at the offtake entrance. The required height will to some extent depend on the treatment process and rate, with more aggressive stirring and greater splashing of more rapid treatment requiring a greater height to the bottom of the offtake outlet. This height should be at least about 50% of the inside diameter of the open bottom 37 for less aggressive, slower processes, and preferably from about 75% to 150% or more of this diameter when the system is used for more rapid, aggressive treatment.

At the end of the degassing, sensors and/or samplers might be used and alloys added as required.

Upon completion of the treatment process, the vacuum pumps are deactuated, and the interior of the tank and the vacuum treatment chamber are flooded with $N_2$, and permitted to return to atmospheric pressure. Thereafter, the hydraulic cylinders 86, 90 are actuated to lift the cover assembly and the tank car is driven to retract the cover assembly from above the ladle. Further testing of the treated metal can then take place under atmospheric pressure. The stirring gas system can then be disconnected, and the overhead crane used to remove the ladle of vacuum treated metal for further processing, as e.g., by continuous casting.

Figure 4:
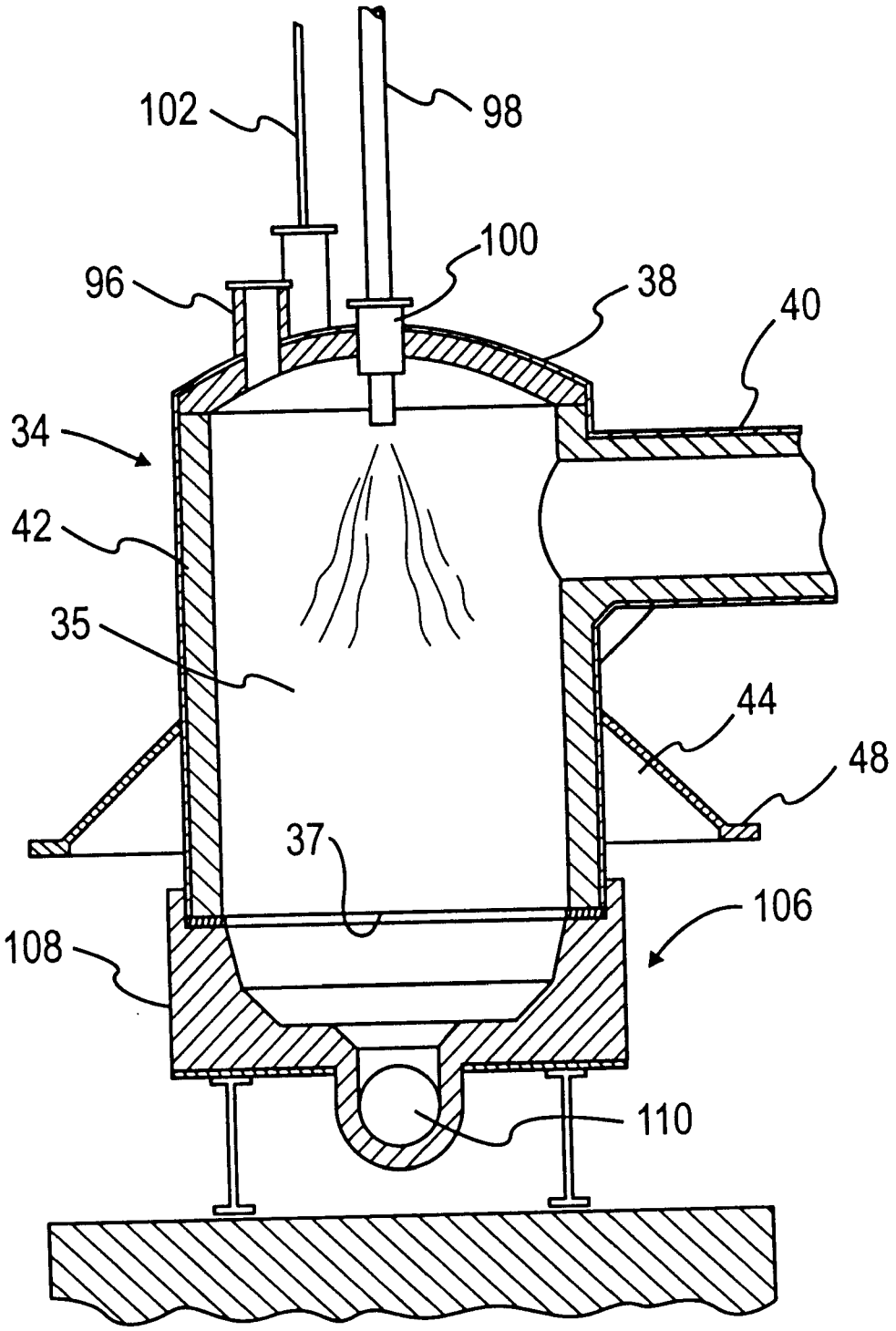
FIG. 4 is an elevation view, in section, of the cover assembly at rest at a cover heating station.

As indicated above, the interior refractory material of the cover chamber is preferably maintained at an elevated temperature, which means that heat should be applied when the assembly cover is not in use for extended periods of time. This may be accomplished at the retracted position where the cover chamber 35 is either lowered onto a stationary heating station, or by providing a movable heating station which is moved into position beneath the cover chamber. As illustrated in FIG. 4, the lance 98 may be operated in an oxy-fuel burner mode or a special burner m ay be used to supply heat within the cover chamber to maintain the refractory lining temperature at a level to minimize heat loss in the treated liquid steel and to avoid excessive buildups on the inner sidewall of the cover chamber. The heating unit includes a base 106 and an off gas outlet 108 for conducting the heating gases to a suitable cleaning and treatment facility before being released into the atmosphere.

Figure 5:
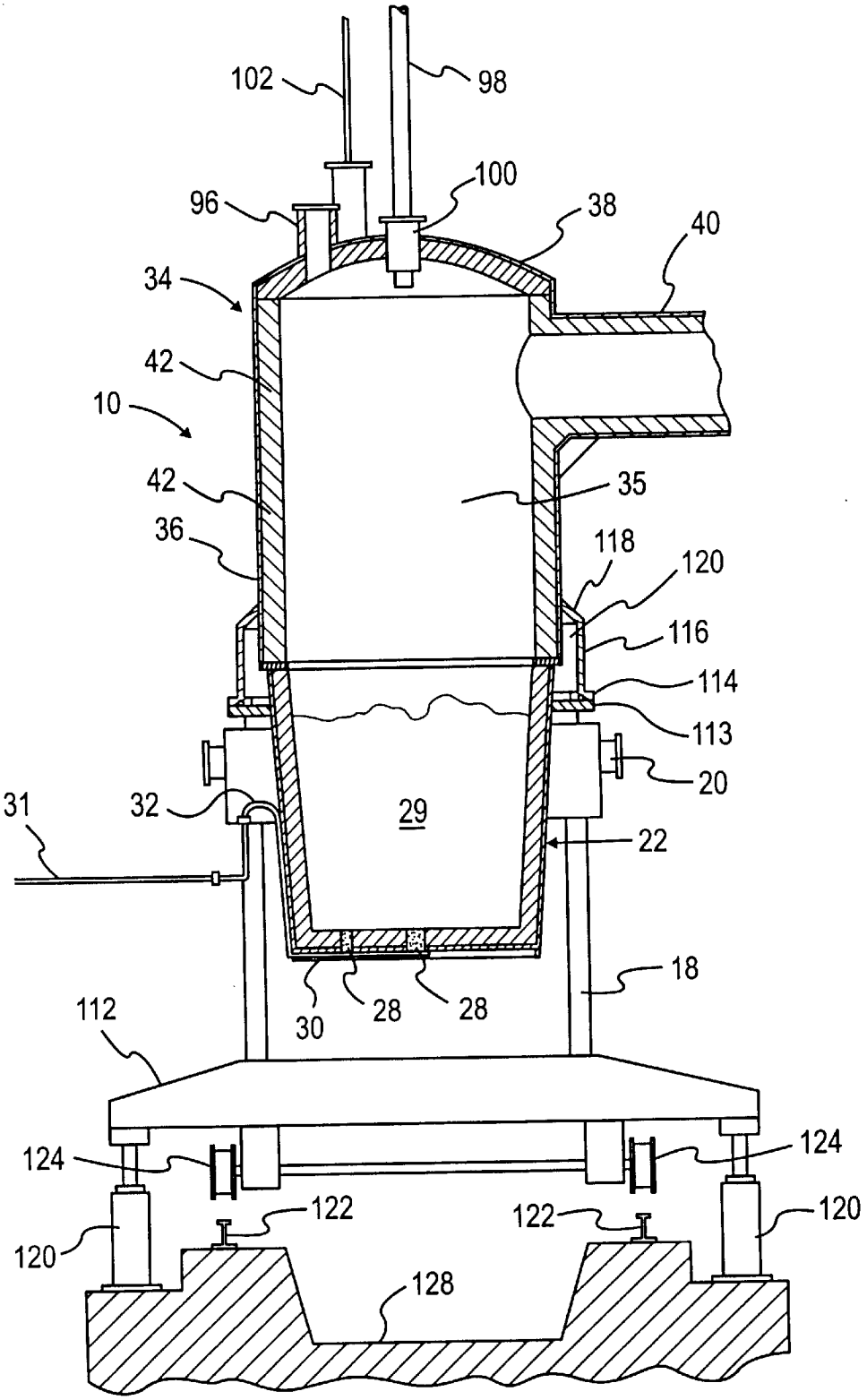
FIG. 5 is a view similar to FIG. 1 showing an alternate embodiment of the invention.

Referring now to FIG. 5, an alternate embodiment of the invention is illustrated in which the tank is eliminated, and the system is effectively operated as a ladle cover type vacuum treatment facility. In this arrangement, the ladle 22 and ladle stand 18 are supported on a ladle car 112 for movement to a position beneath a stationary cover assembly 34, and the ladle is raised to complete the vacuum-tight connection. In this embodiment, the cover assembly and evacuation system are essentially the same as described above with regard to the embodiment in FIGS. 1 and 2, with the exception of the manner of forming the vacuum-tight joint between the ladle and cover assembly. Accordingly, like reference numerals are employed to designate like components of the two assemblies, and the detailed structure of the ladle, stirring system, cover and the exhaust system will not be again described.

In the FIG. 5 embodiment, an annular, ring type flange 113 is formed on and extends radially outward from the ladle shell, at the upper area of the ladle. Flange 113, in the operating position, mates with a second flange 114 installed on the downwardly projecting open end of sleeve 116, spaced outwardly from and projecting below the open bottom end 37 of the cover chamber 35, with this sleeve 16 being rigidly joined as by a conical structural flange 118, to the outer cylindrical shell 36. Resilent seal similar to seal 50 is employed between flanges 113 and 114 to provide a vacuum-tight joint. Thus, this arrangement provides a relatively small vacuum-tight annular chamber 120 surrounding the refractory joint between the top of the ladle and the open bottom end of the cover chamber, with the vent tubes 72 providing gas communication between this annular chamber 120 and interior of the vacuum treatment chamber. Still referring to FIG. 5, the ladle stand 18 is shown mounted on the ladle car 112 for movement therewith along rails 122 by wheels 124 to move a ladle into a treatment position beneath the cover assembly 34. In this arrangement, the cover chamber, vacuum conduits, off gas cooler and associated equipment may be stationarily mounted. To form the vacuum-tight joint, a plurality of fluid actuated cylinders 126 are mounted on a fixed support base 128 in position to engage and lift the ladle car 112, with a ladle 22 supported thereon, to bring the ladle open top, with the joint material 70 thereon, into engagement with the open bottom 37 of the cover chamber 35 and to firmly seat flange 113 onto flange 114. Thereafter, treatment of the molten metal in the ladle is as described above.

While preferred embodiments of the invention have been described, it is believed apparent that various modifications might be made. For example, a turret may be used to move the ladles into position beneath the cover. In this arrangement, a pair of rotating ladle holding arms would be provided so that, as a treated ladle is moved, a second is moved into place. While the second ladle is being processed, the treated ladle is removed and another ladle is placed in position for movement into the treating position. Also, when the ladle is moved beneath the cover, either the ladle or the cover chamber may be vertically movable to complete the vacuum-tight connection.

It is also believed apparent that this vacuum treatment facility may be applied to other metal holding containers such as, for example, a modified, sealed bottom part of a primary melting unit such as an electric arc furnace. In such an arrangement, the furnace roof and electrodes would be removed and replaced by the cover assembly, with suitable vacuum sealing means such as described above being applied to maintain the necessary vacuum. Accordingly, the term ladle as used herein and in the claims should be interpreted to include all such metallurgical vessels or containers.

Also, ladles having an oval or obround cross section may be used, in which case the cover chamber would be similarly shaped and the term "generally cylindrical" is intended to include all such shapes as well as cover chambers, which may be tapered from bottom to top.

Various modifications such as O-ring cooling, automatic activation of the gas stirring system, or even the substitution electromagnetic stirring for gas stirring may be employed. In any embodiment, it is, of course, important t o provide the relatively simply cover assembly including a cover chamber having sufficient height and a suitable hot refractory lining to enable the rapid and effective treatment of molten metal. It is also believed apparent that the simple design of the cover assembly will make it easy to inspect, repair and reline, adding further to the cost efficiency of the improved degasser proposed in this invention. Accordingly, while preferred embodiments have been disclosed and described, it should be understood that the invention is not so limited, but rather that it is intended to include all embodiments thereof which would be apparent to one skilled in the art which come within the spirit and scope of the invention.

What is claimed is:

1. A method of degassing molten metal comprising:

providing a quantity of molten metal in a ladle having an open top, providing a cover assembly including a refractory lined cover chamber having a closed top, an open bottom, a generally cylindrical body section having a diameter substantially equal to the diameter of the open top of the ladle, and a gas offtake for connecting the cover chamber to a vacuum pump to evacuate the cover chamber, moving said cover assembly relative to said ladle to position said cover chamber open bottom on said ladle open top, said cover chamber and said ladle cooperating to define a vacuum treatment chamber, providing a temporary joint between said cover chamber open bottom and said ladle open top, said joint being effective to preclude the flow of molten metal from said vacuum treatment chamber, providing a vacuum seal sealing said vacuum treatment chamber from the atmosphere, applying a vacuum within said vacuum treatment chamber; and stirring the molten metal in said ladle to produce sufficient turbulence in and splashing of the molten metal to thereby produce an increased surface area of molten metal exposed to vacuum for a sufficient time to substantially degas the molten metal, said gas offtake being located above said cover chamber open bottom a distance to substantially prevent splashed molten metal or slag from being carried into the gas offtake.

2. The method according to claim 1 wherein the distance from said cover chamber open bottom to said gas offtake is at least about one-half the internal diameter of said cover chamber at said open bottom.

3. The method according to claim 1 wherein the step of providing a temporary joint includes providing a formable, heat resistant material between said cover chamber open bottom and said ladle open top.

4. The method according to claim 1 wherein the step of providing said vacuum seal comprises providing a pair of flanges mounted one on the outer surface of said cover chamber and one on the outer surface of said ladle, said flanges engaging one another when said cover chamber open bottom is positioned on said ladle open top, and providing a resilient sealing element between said flanges to form a substantially vacuum-tight seal therebetween.

5. The method according to claim 4 wherein the step of providing said seal comprises providing a sealed chamber surrounding and enclosing said temporary joint external of said vacuum treatment chamber and said ladle, and providing vent means for equalizing the pressure in said vacuum treatment chamber and said sealed chamber when vacuum is applied within said vacuum treatment chamber.

6. The method according to claim 1 wherein said gas offtake is positioned at a location which is above said open bottom a distance at least about 75% of the internal diameter of said cover chamber at said open bottom.

7. The method according to claim 1 where the step of providing said vacuum seal comprises providing an open-top tank and placing said ladle in said tank, and providing a pair of flanges one mounted on the open top of said tank and one mounted on the external surface of said cover chamber, said flanges engaging one another when said cover chamber open bottom is positioned on said ladle open top.

8. The method according to claim 7 further comprising the step of providing resilient sealing means between said pair of flanges to affect the vacuum-tight seal.

9. The method according to claim 7 wherein said gas offtake is positioned at a location which is above said open bottom a distance of at least about one-half of the internal diameter of said cover chamber at said open bottom.

10. The method according to claim 9 wherein said gas offtake is positioned at a location which is above said open bottom a distance at least about 75% of the internal diameter of said cover chamber at said open bottom.

11. The method according to claim 1 further comprising the step of heating said cover chamber, prior to positioning said cover chamber on said ladle, to a temperature to minimize the solidification of splashed metal and slag on the inner surface of the cover chamber during degassing.

12. The method according to claim 1 wherein the step of moving said cover assembly relative to said ladle comprises providing a cover car movable from a retracted position spaced from the ladle and a treatment position above said ladle, and mounting said cover assembly on said cover car for movement therewith.

13. The method according to claim 1 wherein the step of moving said cover assembly relative to said ladle comprises providing a ladle car movable from a retracted position spaced laterally from said cover chamber and a treatment position beneath said cover chamber, and supporting the ladle on said ladle car for movement therewith.

14. The method according to claim 1 further comprising the step of providing a lance opening in said closed top, mounting a lance for movement in said opening, providing a vacuum-tight seal between said lance and said closed top, and employing said lance to inject gas into or onto the liquid metal in said ladle during degassing.

15. The method according to claim 14 wherein said lance is a multi-purpose lance, and wherein said method further comprises the step of utilizing said lance to inject an oxygen-fuel mixture into the cover chamber and burning the oxygen-fuel mixture to heat the refractory lining thereof when said cover chamber is not in use to apply vacuum to molten metal in a ladle.

16. The method according to claim 1 further comprising the step of providing an alloy port in said cover chamber, and utilizing said alloy port to add alloy materials to the molten metal.

17. A molten metal treating apparatus for degassing molten metal in an open ladle comprising, a cover assembly including a cover chamber movable relative to the ladle to position said cover chamber over and close the open top of the ladle containing molten metal to be degassed, said cover chamber having a closed top, an open bottom, and a generally cylindrical body portion having a cross section generally corresponding to the size and shape of the open top of the ladle, said cover chamber cooperating with the ladle to define a closed vacuum treatment chamber, a gas offtake outlet in said cover chamber for connecting the interior of the cover chamber to a vacuum pumping system for applying a vacuum in said vacuum treatment chamber, said gas offtake being spaced above said open bottom a distance to substantially prevent molten metal splashes from entering the gas offtake, joint means providing a temporary joint between said cover chamber open bottom and the open top of the ladle, said temporary joint being effective to prevent the flow of splashed molten metal or slag from the vacuum treatment chamber during degassing, seal means providing a vacuum seal between said vacuum treatment chamber and the atmosphere, and means for stirring molten metal in the ladle to provide sufficient turbulence therein and splashing of the molten metal to thereby produce an increased surface area of liquid metal exposed to vacuum applied within said vacuum treatment chamber.

18. The molten metal treating apparatus according to claim 17 wherein said seal means comprises a pair of flanges and flange mounting means supporting one of said flanges on the external surface of said cover chamber and the other said flange on the external surface of the ladle, said pair of flanges engaging one another when said cover chamber is positioned on the ladle, and a resilient seal member between said flanges providing a substantially vacuum-tight seal therebetween.

19. The molten metal treating apparatus according to claim 18 wherein said pair of flanges are spaced outwardly from the external surface of said cover chamber, and wherein said flanges and said flange mounting means cooperate with the outer surfaces of said cover chamber and the ladle to define an annular chamber surrounding said temporary joint.

20. The molten metal treating apparatus according to claim 19 wherein said temporary joint includes vent means for equalizing the pressure between said annular chamber and said vacuum treatment chamber.

21. The molten metal treating apparatus according to claim 17 wherein said gas offtake is located above said open bottom a distance of at least about one-half the internal diameter of said cover chamber at said open bottom.

22. The molten metal treating apparatus according to claim 17 wherein said gas offtake is located above said open bottom a distance of at least about 75% of the internal diameter of said cover chamber at said open bottom.

23. The molten metal treating apparatus according to claim 17 wherein said cover chamber comprises an external steel shell having a refractory inner lining.

24. The molten metal treating apparatus according to claim 23 further comprising means for heating said refractory inner liner prior to positioning said cover chamber on said ladle to thereby minimize the solidification of splashed molten metal and slag on the cover chamber during degassing of molten metal.

25. The molten metal treating apparatus according to claim 17 further comprising a tank having an open top and a ladle support mounted in the tank for supporting a ladle of molten metal during degassing, said tank having a first flange extending around its open top, and a second flange mounted on the outer surface of said cover chamber in outwardly spaced relation thereto, said first and second flanges engaging one another to support said cover chamber when said open bottom is positioned on the ladle open top.

26. The molten metal treating apparatus according to claim 25 further comprising a resilient sealing material between said first and second flanges providing a vacuum-tight seal therebetween.

27. The molten metal treating apparatus according to claim 17 wherein said temporary joint comprises a layer of formable refractory material deposited on the open top of the ladle, said formable refractory material being shaped by said open bottom to produce the joint when the cover chamber is placed on the ladle open top.

28. The molten metal treating apparatus according to claim 26 wherein said temporary joint further comprises a plurality of preformned vent members providing vents through said temporary joint.

29. The molten metal treating apparatus according to claim 17 further comprising a movable cover car supporting said cover for movement between a retracted position spaced laterally from said ladle and a treatment position above said ladle and for vertical movement between a raised position in which said open bottom is spaced above the ladle and a lowered position in which said open bottom is positioned on the ladle open top.

30. The molten metal treating apparatus according to claim 17 further comprising a ladle car supported on tracks for movement between a first position spaced laterally from said cover chamber and a second position beneath said cover chamber, and power means for producing relative vertical movement between said cover chamber and said ladle car to position said open bottom on the open top of a ladle on the ladle car at said second position.

31. The molten metal treating apparatus according to claim 17 further comprising a lance mounted on said cover chamber and extending into said vacuum treatment chamber, said lance being operable to inject gas into said vacuum treatment chamber.

32. The molten metal treating apparatus according to claim 30 further comprising an alloy port in said cover chamber for the addition of alloy materials to molten metal in said vacuum treatment chamber.

33. The method according to claim 1 wherein the step of providing a temporary joint includes providing intermitting contoured surfaces on said cover chamber open bottom and said ladle open top.

34. The method according to claim 33 wherein said contoured surfaces define a shiplap joint.

35. The molten metal treating apparatus according to claim 17 wherein said joint means comprises interfitting contoured surfaces on said cover chamber open bottom and said ladle open top.

* * * * *

UNITED STATES PATENT AND TRADEMARK OFFICE

CERTIFICATE OF CORRECTION

PATENT NO. : 5,917,115

DATED : June 29, 1999

INVENTOR(S) : Erich F. WONDRIS

It is certified that error appears in the above-indentified patent and that said Letters Patent is hereby corrected as shown below:

Claim 28, line 3 (column 13, line 5), change "preformned" to -- preformed --;

Claim 33, line 2, (column 14, line 11), change "intermitting" to -- interfitting --.

Signed and Sealed this

Eighth Day of February, 2000

*Attest:*

*Attesting Officer*

Q. TODD DICKINSON

*Commissioner of Patents and Trademarks*